US009206517B2

(12) United States Patent
Faita

(10) Patent No.: US 9,206,517 B2
(45) Date of Patent: Dec. 8, 2015

(54) ANODIC COMPARTMENT FOR METAL ELECTROWINNING CELLS

(71) Applicant: INDUSTRIE DE NORA S.P.A., Milan (IT)

(72) Inventor: Giuseppe Faita, Novara (IT)

(73) Assignee: INDUSTRIE DE NORA S.P.A., Milan (IT)

( * ) Notice: Subject to any disclaimer, the term of this patent is extended or adjusted under 35 U.S.C. 154(b) by 0 days.

(21) Appl. No.: 14/350,863

(22) PCT Filed: Oct. 25, 2012

(86) PCT No.: PCT/EP2012/071172
§ 371 (c)(1),
(2) Date: Apr. 10, 2014

(87) PCT Pub. No.: WO2013/060786
PCT Pub. Date: May 2, 2013

(65) Prior Publication Data

US 2014/0246306 A1 Sep. 4, 2014

(30) Foreign Application Priority Data

Oct. 26, 2011 (IT) ..... MI2011A001938

(51) Int. Cl.
*C25C 7/02* (2006.01)
*C25C 7/04* (2006.01)
*C25C 7/00* (2006.01)

(52) U.S. Cl.
CPC .... *C25C 7/00* (2013.01); *C25C 7/04* (2013.01)

(58) Field of Classification Search
CPC ..... C25C 7/02; C25C 7/04; C25C 1/08; C25C 1/12; C25B 13/02; C25D 17/002; C25D 17/02; C25D 17/04; C25D 17/10; C25D 17/12
USPC ..... 204/252, 264, 266, 276, 278, 278.5, 204/282, 283, 284, 293, 285, 297.01, 295
See application file for complete search history.

(56) References Cited

U.S. PATENT DOCUMENTS 4,075,069 A 2/1978 Shinohara et al.
4,201,653 A * 5/1980 O'Neill et al. ..... 204/263

(Continued)

FOREIGN PATENT DOCUMENTS

GB 1022005 3/1966
JP 1065286 3/1989

OTHER PUBLICATIONS

Galson Laboratories (Hexavalent Chromium, 2006, http://www.galsonlabs.com/resourcecenter/bulletin.php?c=41).*

(Continued)

*Primary Examiner* — Luan Van
*Assistant Examiner* — Alexander W Keeling
(74) *Attorney, Agent, or Firm* — Lucas & Mercanti LLP.

(57) ABSTRACT

The present invention concerns an anodic compartment for metal electrowinning cells delimited by a frame-shaped skeleton comprising an envelope including a permeable separator secured to said frame-shaped skeleton by means of a frame-shaped flange, at least one anode obtained starting from a valve metal substrate coated with at least one corrosion-resistant catalytic layer, said anode being inserted inside said envelope, and a demister located above said anode and delimited by said separator and said skeleton. The invention also concerns an electrochemical cell for metal electrowinning comprising at least one such anodic compartment.

6 Claims, 1 Drawing Sheet

(56) References Cited

U.S. PATENT DOCUMENTS

| | | | | |
|---|---|---|---|---|
| 4,226,685 | A * | 10/1980 | Portal et al. | 205/348 |
| 4,441,977 | A * | 4/1984 | Ford | 204/252 |
| 5,312,533 | A * | 5/1994 | Mayr et al. | 204/282 |
| 6,017,428 | A * | 1/2000 | Hill et al. | 204/242 |
| 6,054,027 | A * | 4/2000 | Ebert | 204/267 |
| 6,120,658 | A * | 9/2000 | Dunn et al. | 204/279 |
| 6,287,433 | B1 * | 9/2001 | Sapozhnikova | 204/293 |
| 2009/0288958 | A1 * | 11/2009 | Sandoval et al. | 205/576 |

OTHER PUBLICATIONS

Shin et al. (American Industrial Hygiene Association, 2000, http://www.ncbi.nlm.nih.gov/pubmed/10976687).*

International Search Report issued in PCT Application No. PCT/EP2012/071172.

* cited by examiner

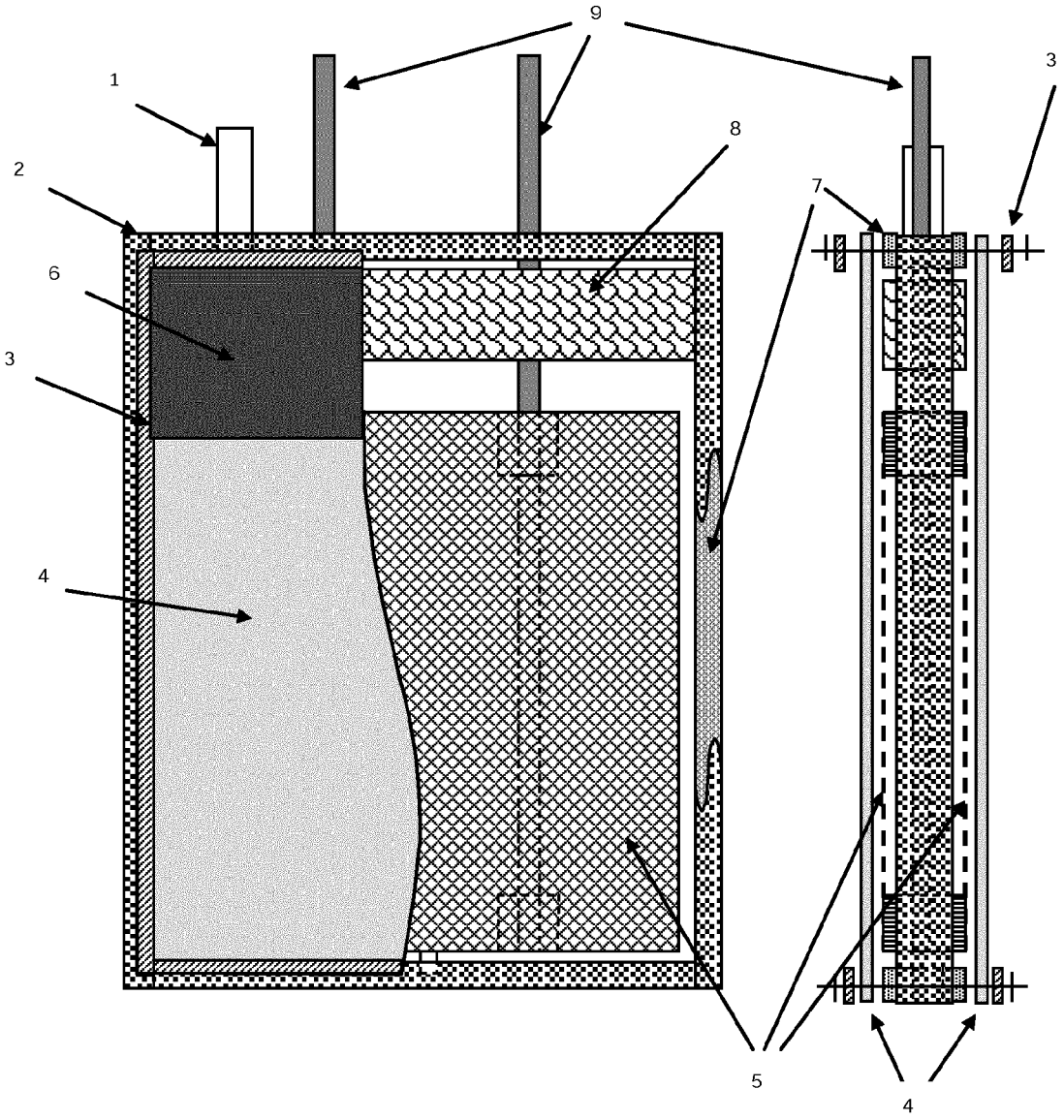
9
1
3
8
2
7
6
3
4
5
4

ANODIC COMPARTMENT FOR METAL ELECTROWINNING CELLS

This application is a U.S. national stage of PCT/EP2012/071172 filed on Oct. 25, 2012 which claims the benefit of priority from Italy Patent Application No. MI2011A001938 filed Oct. 26, 2011, the contents of each of which are incorporated herein by reference.

FIELD OF THE INVENTION

The invention relates to an anodic compartment of a cell for metal electrowinning equipped with an anode consisting of a metal substrate provided with a coating comprising a catalytic layer. The anodic compartment is designed for containing oxygen bubbles generated by the anodic reaction on the surface of the anode.

BACKGROUND OF THE INVENTION

Electrowinning processes are generally carried out in undivided electrochemical cells containing an electrolytic bath and a multiplicity of anodes and cathodes; in such processes, such as for instance copper electrodeposition, the electrochemical reaction taking place at the cathode, generally made of stainless steel, leads to the deposition of copper in metallic form on the cathode itself. At the anode, generally made of lead, as the result of the electrochemical reaction gaseous oxygen is produced, which is detached from the electrode surface in form of bubbles migrating toward the electrolyte surface. Once they reach the free surface of the electrolyte, bubbles break giving rise to an acidic mist (aerosol), fundamentally consisting of acid electrolyte droplets suspended in the atmosphere overlying the electrolytic bath. Acid mists, besides being noxious for the health of people working in the surrounding environment, are corrosive and dangerous for all metal parts of the cell room and may damage the instrumentation present.

Several chemical and physical techniques are known and used for controlling the concentration of acid mists released in the environment surrounding metal electrodeposition cells; these include the employment of surfactants and mechanical methods such as for instance the use of layers of beads floating on the electrolyte surface, which force the gas bubbles along a tortuous path where separation of acid mists takes place.

Recently there have been attempts to replace lead anodes, subject to releasing noxious material in the course of time, with non-consumable anodes obtained on a superficially catalysed substrate of titanium or other valve metal. Besides guaranteeing a better energy efficiency, this kind of anode is more resistant to corrosion also circumventing the problem of lead impurities produced during the process.

It was nevertheless observed that oxygen evolution on the latter kind of anodes evolves oxygen in form of bubbles of much reduced size (microbubbles), leading to a higher release of acid mists compared to lead anodes. The above cited methods for controlling acid mists don't have therefore the same efficacy.

It has thus been evidenced the need of providing a new system suitable for reducing or eliminating acid mists in electrodeposition processes making use of valve metal anodes comprising superficial catalytic layers.

SUMMARY OF THE INVENTION

Various aspects of the invention are set out in the accompanying claims.

Under one aspect, the invention relates to an anodic compartment of a metal electrowinning cell delimited by a frame-shaped skeleton comprising one anode obtained starting from a valve metal substrate coated with at least one corrosion-resistant catalytic layer, said anode being inserted inside an envelope consisting of a permeable separator, said permeable separator being secured to said frame-shaped skeleton by means of a an also frame-shaped flange, a demister being located above the anode and delimited by said permeable separator and said skeleton. A configuration of such kind has the advantage of keeping microbubbles confined in an enclosed space. The frame-shaped skeleton for securing the permeable separator may be of plastic material, for instance being formed by four straight segments fixed at the extremities. The flange element for securing the permeable separator to the frame can also be of plastic material and fixed for instance by bolting.

By the term anodic compartment as used herein is meant a structure which is applied for each anode present in the electrodeposition cell, optionally to replace a pre-existing lead anode. In one embodiment, the anodic compartment comprises an anode with a mechanical structure consisting of an expanded mesh, a punched sheet or a planar sheet.

Alternatively, the anodic compartment comprises an anode having a mechanical structure consisting of a pair of expanded meshes or punched sheets arranged in parallel and facing each other. The latter solution providing an anode subdivided into two parallel facing elements can have the advantage of minimising the ohmic drop and homogenising current distribution.

In one embodiment, the anodic compartment according to the invention comprises an anode having a single or double mechanical structure wherein the valve metal of the substrate is titanium and at least one catalytic layer applied on the substrate comprises oxides of iridium and of tantalum.

In a further embodiment, the anodic compartment comprises a permeable separator which may consist of a porous sheet or a cation-exchange membrane, for instance of the hydrocarbon type. In case the porous separator is a porous sheet, the portion of sheet in contact with the gas phase may optionally be provided with an impervious layer in order to prevent the possible leakage of oxygen to the environment.

In one embodiment the demister is made of a plastic material or of a layer of expanded plastic foam or of closely packed thin blades. The demister has the purpose of detaining the acidic electrolyte mists drafted by oxygen separated from the liquid phase. After passing across the demister, oxygen is vented to the atmosphere or preferably sent to a manifold connected to an aspirator to further reduce the possible residual acid mist traces preventing inasmuch as possible their release to the external environment.

Under another aspect the invention relates to an electrochemical cell for metal electrowinning comprising at least one anodic compartment as above described.

The proposed structure is suitable for installation in plants of metal extraction by electrochemical way, in particular for copper and nickel extraction, of new construction or as a replacement of pre-existing lead electrodes.

Some implementations exemplifying the invention will now be described with reference to the attached drawing, which has the sole purpose of illustrating the reciprocal arrangement of the different elements relatively to said particular implementations of the invention; in particular, drawings are not necessarily drawn to scale.

BRIEF DESCRIPTION OF THE DRAWING

FIG. 1 shows a front view and the corresponding side view of a possible embodiment of an anodic compartment comprising an anode formed by a pair of expanded meshes having two current-collecting bars arranged in their interior.

DETAILED DESCRIPTION OF THE DRAWING

FIG. 1 shows a front view and the corresponding side view of one embodiment of the anodic compartment delimited by a plastic skeleton 2, a securing flange 3 whereto a porous separator 4 is fixed, an anode formed by a pair of parallel expanded meshes facing each other 5, a lining 6 directed to prevent the leakage of oxygen to the external environment, gaskets 7, a demister 8, current-collecting bars 9 and oxygen outlet nozzle 1.

Some of the most significant results obtained by the inventors are presented in the following examples, which are not intended as a limitation of the extent of the invention.

EXAMPLE

An anodic compartment as shown in FIG. 1 was assembled in a lab experimental cell. The cell comprised two 100 cm tall and 70 cm wide stainless steel cathodes with an anodic compartment according to FIG. 1 placed in-between comprising an anode obtained starting from a substrate consisting of a pair of 70×70 cm parallel expanded meshes facing each other made of titanium, having a tantalum and iridium oxide-based catalytic layer with an overall loading of 9 g/m$^2$ and a molar ratio Ta:Ir of 35:65 referred to the elements. The anodic compartment further comprised two sheets of porous polypropylene hydrophilised with silica powder, equipped in the top part with a thin layer of gas-impervious neoprene, and a demister consisting of an open cell expanded polyurethane body having pores of 100 μm average diameter. Copper was electrowon for 5 hours at constant current density of 700 A/m$^2$. The electrolyte contained 60 g/l cupric sulphate and 100 g/l sulphuric acid. Acid aerosols characterisations were carried out at an approximate height of 40 cm above the cell level on the whole perimeter for a time of 45 minutes. An average concentration of 0.3 mg aerosol per m$^3$ of air was detected.

Counterexample

A cell was assembled comprising two 100 cm tall and 70 cm wide stainless steel cathodes with an anode placed in-between obtained starting from a substrate consisting of a pair of 70×70 cm parallel expanded meshes facing each other made of titanium, having a tantalum and iridium oxide-based catalytic layer with an overall loading of 9 g/m$^2$ and a molar ratio Ta:Ir of 35:65 referred to the elements. Copper was electrowon for 5 hours at constant current density of 700 A/m$^2$. The electrolyte contained 60 g/l cupric sulphate and 100 g/l sulphuric acid. Three layers of hollow polypropylene beads with a diameter of 19 mm were placed on the exposed surface of the electrolyte. Acid aerosols characterisations were carried out at an approximate height of 40 cm above the cell level on the whole perimeter for a time of 45 minutes. An average concentration of 1.3 mg aerosol per m$^3$ of air was detected.

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

The invention claimed is:

1. Anodic compartment for metal electrowinning cells comprising a rigid frame-shaped skeleton comprising:

an envelope including a permeable separator secured to said rigid frame-shaped skeleton by means of a rigid frame-shaped flange, at least one anode obtained starting from a valve metal substrate coated with at least one corrosion-resistant catalytic layer, said anode being inserted inside said envelope a demister located above said anode and delimited by said separator and said skeleton, wherein said permeable separator is a porous sheet having a portion of the sheet in contact with the gas phase provided with a gas-impervious layer.

2. Anodic compartment for metal electrowinning cells according to claim 1, wherein said valve metal substrate has a mechanical structure consisting of an expanded mesh, a punched plate or a planar plate.

3. Anodic compartment according to claim 1, wherein said valve metal substrate has a mechanical structure consisting of a pair of expanded meshes or punched plates disposed in parallel and facing each other.

4. Anodic compartment according to claim 1, wherein the valve metal of said substrate is titanium and said catalytic layer of said anode comprises oxides of iridium and tantalum.

5. Anodic compartment according to claim 1, wherein said demister is made of a plastic material or of a layer of expanded plastic foam or of closely packed thin blades.

6. Electrochemical cell for metal electrowinning comprising at least one anodic compartment according to claim 1.

* * * * *